US007202827B2

(12) United States Patent
Donald

(10) Patent No.: US 7,202,827 B2
(45) Date of Patent: Apr. 10, 2007

(54) WINDOW MOUNTABLE DIPOLE ANTENNA SYSTEM

(76) Inventor: Roger Donald, 6500 Fieldcrest Dr., Fort Smith, AR (US) 72916

( * ) Notice: Subject to any disclaimer, the term of this patent is extended or adjusted under 35 U.S.C. 154(b) by 0 days.

(21) Appl. No.: 11/135,837

(22) Filed: May 23, 2005

(65) Prior Publication Data

US 2006/0262024 A1 Nov. 23, 2006

(51) Int. Cl.
*H01Q 1/32* (2006.01)

(52) U.S. Cl. ..... 343/715; 343/713; 343/793; 343/901

(58) Field of Classification Search ..... 343/713, 343/715, 704, 711, 793, 900, 901
See application file for complete search history.

(56) References Cited

U.S. PATENT DOCUMENTS

| | | | | |
|---|---|---|---|---|
| 5,027,128 | A * | 6/1991 | Blaese | 343/713 |
| 5,805,113 | A * | 9/1998 | Ogino et al. | 343/713 |
| 6,019,340 | A * | 2/2000 | Hanaoka | 248/515 |
| 6,087,996 | A * | 7/2000 | Dery | 343/713 |
| 6,300,912 | B1 * | 10/2001 | Pla | 343/713 |

* cited by examiner

*Primary Examiner*—Tho Phan
(74) *Attorney, Agent, or Firm*—Dennis B. Haase

(57) ABSTRACT

A dipole antenna for use in a vehicle, or the like, having individual positioners to receive antenna rods such that the antenna may be mounted out of the vision of the vehicle operator while providing optimum performance, and an amplifier in the antenna circuit to further enhance the signal.

2 Claims, 1 Drawing Sheet

WINDOW MOUNTABLE DIPOLE ANTENNA SYSTEM

The present invention relates, in a general sense, to antennas and, more particularly, to a dipole antenna for receipt of wireless signals in a vehicle, or the like, which is mountable, e.g., on a window, to provide video and audio reception to a portable device requiring an antenna.

BACKGROUND OF THE INVENTION

1. Field of the Invention

The antenna art is as old as radio itself, and, along with audio and video devices, it has evolved over time. Antennas, in the nature of the venerable and easily recognized rabbit ears, were part of the evolution of television, and were, in the early 50s and, to a lesser extent today, perched atop the television. Even with the development of roof antennas, retailers, such as Radio Shack®, still sell devices with rabbit ears with directional and amplification features requiring a 120 volt input and a weighted base upon which the device sits. The directional feature is intended to replace the time honored method of manual manipulation of the rabbit ears.

As society becomes more mobile, portable televisions and audio devices became mobile too, and it is not always convenient to have an antenna mounted on a roof or otherwise in the airstream of a moving vehicle. Nor is it always possible to sit an antenna on a seat or dashboard of a moving vehicle under a steel roof.

In truth, there is, at least until now, nothing subtle or unobtrusive about most antennas. While some radios have carbon core antennas that are such, where there is a television signal involved, that a stronger device is required to pull in an acceptable signal in most locations.

2. Overview of the Existing Art

Among the early efforts to adapt the rabbit ear concept of the antenna art is found in Trowbridge U.S. Pat. No. 2,609,593. Trowbridge appears to have placed the rabbit ears on a circular base which is capable of removably adhering to a surface.

Hannaoka U.S. Pat. No. 6,019,340 is a variation on the theme of Trowbridge, although Hannaoka adds a rubber cushion on the base.

More to the point is Ogino et al. U.S. Pat. No. 5,805,113, which is a satellite antenna which is mounted to the rear window of a vehicle with planer antenna rods projecting outwardly from a central holder. Pla, in his U.S. Pat. No. 6,300,912, proposes a visually similar unit with an adhesive strip on the base to hold the antenna dipole rods, projecting in a plane therefrom, to a windshield or the like.

SUMMARY OF THE INVENTION

While antenna technology has been familiar in the art for as long as sound and images have been transmitted by wireless means, and while there has been some effort to reduce the cumbersomeness of devices for receiving wireless signals, the obtrusiveness of existing units remains a problem for those who wish to receive such wireless transmissions while in a vehicle or the like. It is, therefor, one of the primary objectives of the present invention to provide an antenna which is both small and unobtrusive when used in a vehicle.

It is another objective of the present invention to provide a dipole antenna which is so configured as to be mountable to the interior of a windshield in such a manner that it does not interfere with the field or vision of the driver or other occupant.

It is a further objective of the present invention to provide a device for the receipt of a wireless signal in a vehicle and deliver that signal to the device to which the signal is directed with enhanced strength.

It is yet another objective of the present invention to permit adjustment of the dipole antenna bars to fit available space and to be able to accommodate extension of one or both antenna bars to enhance reception.

Other and further objectives and advantages will occur to those skilled in the art from a reading of the following Detailed Description of a Preferred Embodiment taken in conjunction with the attached drawing, wherein:

DETAILED DESCRIPTION OF A PREFERRED EMBODIMENT

Figure 1:
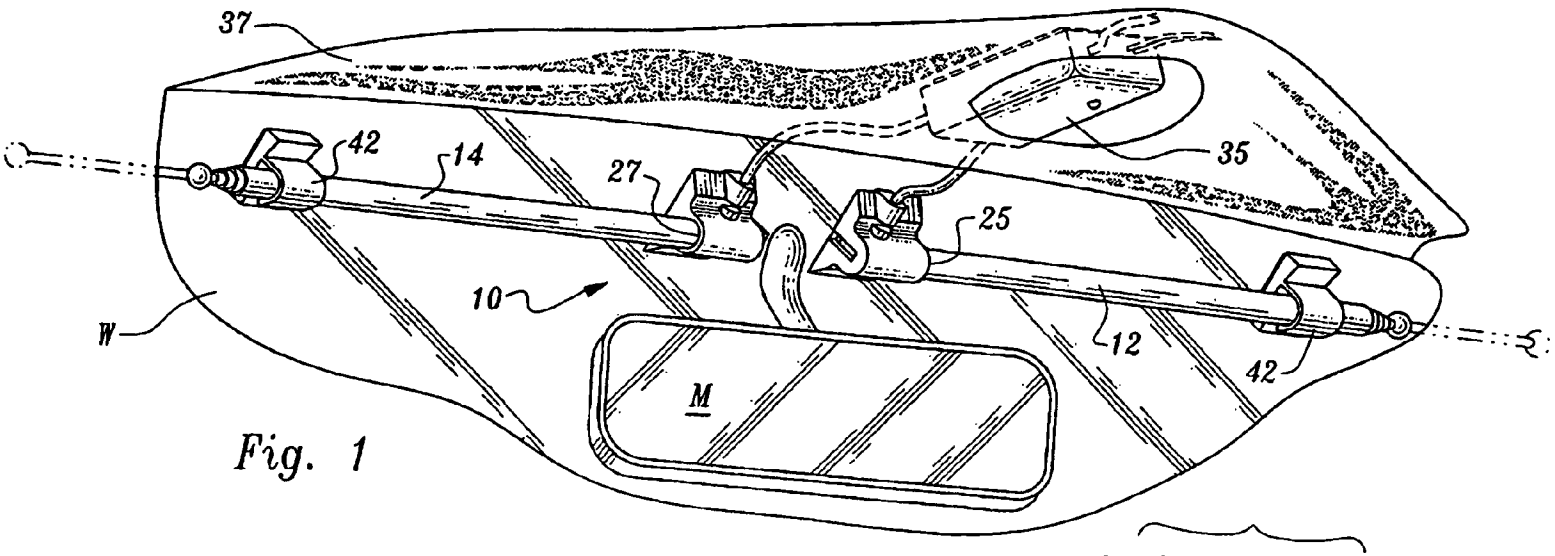
FIG. 1 is a pictorial view of an antenna constructed in accordance with the present invention, as it would be mounted on the inside of a windshield of a vehicle.
Figure 2:
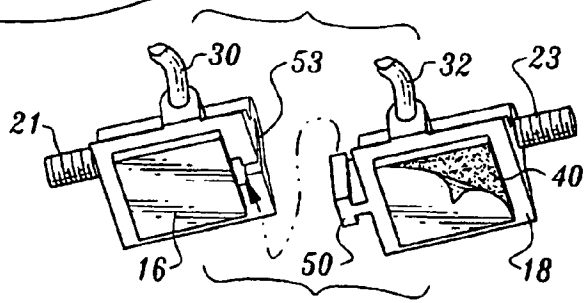
FIG. 2 is a perspective view of the antenna rod positioners of the present invention, illustrating a structure for optionally joining the positioners; and, FIG. 3 is an exploded view of the antenna of FIG. 1, emphasizing the mounting apparatus.
Figure 3:
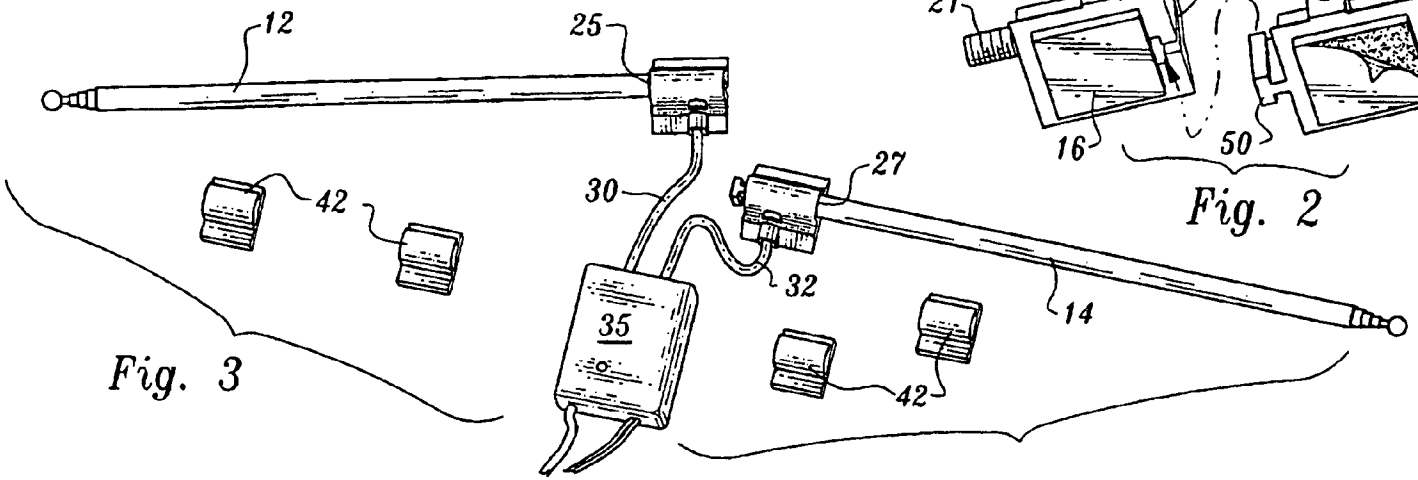

With reference now to the drawings and initially to FIG. 1, a window mounted dipole antenna is shown at 10, as it would appear when mounted to a non metalic surface, e.g., a windshield W of a vehicle, not shown.

The antenna 10 is capable of being adjusted to accommodate available space and the extension of one or more antenna bars. For example, the antenna is capable of being mounted astride the rear view mirror M and, by virtue of that feature, may be mounted immediately adjacent the headliner H of the vehicle and well out of the field of vision of the driver, or occupants, of the vehicle, giving the driver an unimpaired view of the area in front of the vehicle, as well as stop lights and other things, such as signage, above street level. Similarly, one or both antenna bars may be mounted at other than a horizontal orientation, and at almost any angle, and the individual bars need not be parallel or even at the same angle relative to one another.

The antenna 10 includes a pair of extensible, telescoping antenna rods 12, 14. In keeping with a principal feature of the invention, a pair of individual antenna positioners 16, 18 are provided, each of which is adapted to receive an individual antenna rod, which, by virtue of the separable positioners, may be oriented in any fashion to accommodate the available space and field of vision.

To this end, each antenna positioner is provided with a threaded conductive connector 21, 23. Each telescoping antenna rod is formed, or otherwise provided, with a receiving end 25, 27 having a series of female threads for receipt of a connector such as 21 and 23. Electrical leads 30 and 32 complete a circuit with the antenna rods through the positioners 16 and 18.

The antenna 10, when mounted and connected to a receiver, e.g., a television receiver, transmits a signal through the electrical leads 30, 32, to the receiver. In keeping with another aspect of the invention, an amplifier 35 is interposed in the electrical circuit to provide a signal boost and to minimize noise and other interference and maximize reception by the receiver. It has been determined that a 26 db amplifier provides optimum performance.

By providing individual positioners for the antenna rods, as distinguished from the conventional single base to hold both rods, positioning of the antenna rods becomes both simple and convenient. As seen in FIG. 1, the otherwise obstructive rear view mirror M presents absolutely no problem and instead of mounting the antenna below or to one side of the mirror, where extension of the rods 12 and/or 14 may pose a space limitation or vision impairment, the antenna is readily mounted around the mirror, posing no problem. Moreover, the amplifier 35 is simply secured to the inside of the roof of the vehicle within the headliner 37 and well out of sight.

Once the desired position of the antenna 10 is determined, the invention contemplates the use of a mounting device, such as, an adhesive backing material 40 to literally stick the positioners to the inside of the windshield W, and additional holders 42 may be used to assist in holding the rods 12, 14 in place even when fully extended.

In keeping with yet another feature of the invention, the positioners, if so desired, may be joined to form a single positioner for both rods. To this end, one positioner, in the illustrated case, positioner 18, is formed with a fastener in the form of a tongue 50. The tongue 50 is positioned opposite the connector 23 on the positioner. To complete the fastener, a groove 52 is formed on the positioner 16, and, when the circumstances call for the positioners to be connected, one need only slide the tongue into the groove to complete the union.

It will be appreciated that minor variations in the structure will be evident to those skilled in the art and those variations are within the contemplation of the invention, as defined by the following claims:

The invention claimed is:

1. A dipole antenna, said antenna having a pair of conductive antenna rods, said rods being extensible, a pair of individual positioners, each said positioner being adapted to receive an antenna rod;

said positioners having a mounting device thereon for mounting each said positioner individually on a surface in a predetermined position;

said positioners being selectively connectable to one another; a tongue formed on one of said positioners; a groove formed on the other of said positioners, said positioners being selectively connectable by inserting said tongue into said groove;

a receiver;

an electrically conductive circuit interconnecting said antenna rods and said receiver; and an amplifier interposed in said electrical circuit.

2. The dipole antenna of claim 1, wherein said positioners being oriented on a windshield with said positioners disposed on either side of the rear view mirrors, well out of the field of vision of the occupants of a vehicle.

* * * * *